US010065200B2

(12) United States Patent
Hiemer

(10) Patent No.: US 10,065,200 B2
(45) **Date of Patent: *Sep. 4, 2018**

(54) STATIC SPRAY MIXER

(75) Inventor: Andreas Hiemer, Schuebelbach (CH)

(73) Assignee: SULZER MIXPAC AG, Haag (CH)

( * ) Notice: Subject to any disclaimer, the term of this patent is extended or adjusted under 35 U.S.C. 154(b) by 1586 days.

This patent is subject to a terminal disclaimer.

(21) Appl. No.: 12/850,420

(22) Filed: Aug. 4, 2010

(65) Prior Publication Data

US 2011/0042483 A1 Feb. 24, 2011

(30) Foreign Application Priority Data

Aug. 20, 2009 (EP) ..... 09168285

(51) Int. Cl.
*B05B 7/08* (2006.01)
*B01F 5/06* (2006.01)
(Continued)

(52) U.S. Cl.
CPC ..... *B05B 7/0807* (2013.01); *B01F 5/0641* (2013.01); *B05B 7/0408* (2013.01); *B05B 7/10* (2013.01); *B05C 17/00553* (2013.01)

(58) Field of Classification Search
CPC ..... F23D 14/54; F23D 14/42; F23D 14/52; B05B 7/066; B05B 17/0692; B05B 7/00;
(Continued)

(56) References Cited

U.S. PATENT DOCUMENTS 3,620,506 A * 11/1971 So ..... 366/337
3,893,654 A * 7/1975 Miura et al. ..... 366/337
(Continued)

FOREIGN PATENT DOCUMENTS

DE 39 22 561 A1 1/1991
DE 92 15 107 U1 12/1992
(Continued)

OTHER PUBLICATIONS

Decision on Grant dated Aug. 5, 2014, from Russian Application No. 2010134755 (11 pages).

*Primary Examiner* — Chee-Chong Lee
(74) *Attorney, Agent, or Firm* — Kilpatrick Townsend & Stockton LLP

(57) ABSTRACT

A static spray mixer is proposed for the mixing and spraying of at least two flowable components, having a tubular, one-piece mixer housing (2) which extends in the direction of a longitudinal axis (A) up to a distal end (21) which has an outlet opening (22) for the components, having at least one mixing element (3) arranged in the mixer housing (2) for the mixing of the components as well as having an atomization sleeve (4) which has an inner surface which surrounds the mixer housing (2) in its end region, wherein the atomization sleeve (4) has an inlet (41) for a pressurized atomization medium. A plurality of grooves are provided in the outer surface of the mixer housing (2) or in the inner surface of the atomization sleeve (4) which respectively extend in the direction of the longitudinal axis (A) and through which the atomization medium can flow from the inlet (41) of the atomization sleeve (4) to the distal end (21) of the mixer housing (2).

16 Claims, 10 Drawing Sheets

(51) Int. Cl.
*B05B 7/04* (2006.01)
*B05B 7/10* (2006.01)
*B05C 17/005* (2006.01)

(58) Field of Classification Search
CPC ..... B05B 7/2437; B05B 5/1683; B05B 7/12; B05B 7/0408; A01C 15/04; A01M 9/0046; B01F 5/0641
USPC ..... 239/424.5, 406, 405, 424, 432; 222/145.5, 145.6
See application file for complete search history.

(56) References Cited

U.S. PATENT DOCUMENTS

| | | | | | |
|---|---|---|---|---|---|
| 4,093,188 | A | * | 6/1978 | Horner | 366/336 |
| 4,255,125 | A | * | 3/1981 | Auclair et al. | 431/354 |
| 4,546,923 | A | | 10/1985 | Ii | |
| 4,881,821 | A | | 11/1989 | Stutz | |
| 5,388,764 | A | * | 2/1995 | Moses | 239/74 |
| 6,132,396 | A | * | 10/2000 | Antanavich et al. | 604/82 |
| 6,578,777 | B2 | * | 6/2003 | Bui | 239/406 |
| 6,601,782 | B1 | | 8/2003 | Sandholm et al. | |
| 6,951,310 | B2 | | 10/2005 | Anderson | |
| 2002/0153433 | A1 | | 10/2002 | Hunter | |
| 2003/0226910 | A1 | * | 12/2003 | Anderson | 239/463 |
| 2005/0185508 | A1 | | 8/2005 | Schulz-Hanke et al. | |

FOREIGN PATENT DOCUMENTS

| | | | |
|---|---|---|---|
| DE | 42 16 746 | A1 | 11/1993 |
| EP | 0815929 | A1 | 1/1998 |
| EP | 0 904 844 | A1 | 3/1999 |
| JP | H11-333333 | A | 12/1999 |
| RU | 2288783 | C1 | 12/2006 |

* cited by examiner

STATIC SPRAY MIXER

CROSS REFERENCE TO RELATED APPLICATIONS

This application claims the priority of European Application No. 09 168 285.6, filed on Aug. 20, 2009, the disclosure of which is incorporated herein by reference.

FIELD OF THE INVENTION

The invention relates to a static spray mixer for the mixing and spraying of at least two flowable components in accordance with the preamble of the independent claim(s).

BACKGROUND

Static mixers for the mixing of at least two flowable components are described, for example, in EP-A-0 749 776 and in EP-A-0 815 929. These very compact mixers provide good mixing results, in particular also on the mixing of high-viscosity materials such as sealing compounds, two-component foams or two-component adhesives, despite a simple, material-saving design of their mixer structure. Such static mixers are usually designed for single use and are frequently used for products to be hardened in which the mixer can practically no longer be cleaned.

In some applications in which such static mixers are used, it is desirable to spray the two components onto a substrate after their mixing in the static mixer. For this purpose, the mixed components are atomized at the outlet of the mixer by the action of a medium such as air and can then be applied to the desired substrate in the form of a spray jet or spray mist. Such an apparatus is disclosed, for example, in U.S. Pat. No. 6,951,310.

In this apparatus, a tubular mixer housing is provided which receives the mixing element for the static mixing and which has an external thread at one end onto which a ring-shaped nozzle body is screwed. The nozzle body likewise has an external thread. A conical atomizer element which has a plurality of grooves extending in the longitudinal direction on its cone surface is placed onto the end of the mixing element which projects out of the mixer housing. A cap is pushed over this atomizer element whose inner surface is likewise of conical design so that it contacts the cone surface of the atomizer element. The grooves consequently form flow channels between the atomizer element and the cap. The cap is fixed to the nozzle body together with the atomizer element by means of a retaining nut which is screwed onto the external thread of the nozzle body. The nozzle body has a connection for compressed air. In operation, the compressed air flows out of the nozzle body through the flow channels between the atomizer element and the cap and atomizes the material being discharged from the mixing element.

Even if this apparatus has absolutely proved to be fully functional, its structure is very complex and the installation is complicated and/or expensive so that the apparatus is in particular not very cost-effective with respect to the single use.

Starting from this prior art, it is therefore an object of the invention to propose a particularly simple static spray mixer for the mixing and spraying of at least two flowable components which is cost-effective in its manufacture and enables an efficient mixing or thorough mixing and atomization of the components.

SUMMARY

The subject of the invention satisfying this object is characterized by the features of the independent claim(s).

In accordance with the invention, a static spray mixer is therefore proposed for the mixing and spraying of at least two flowable components, having a tubular, one-piece mixer housing which extends in the direction of a longitudinal axis up to a distal end which has an outlet opening for the components, having at least one mixing element arranged in the mixer housing for the mixing of the components as well as having an atomization sleeve which has an inner surface which surrounds the mixer housing in its end region, wherein the atomization sleeve has an inlet for a pressurized atomization medium. A plurality of grooves are provided in the outer surface of the mixer housing or in the inner surface of the atomization sleeve which respectively extend in the direction of the longitudinal axis and through which the atomization medium can flow from the inlet of the atomization sleeve to the distal end of the mixer housing A particularly simple structure of the static spray mixer results from these measures without any concessions in the quality of the mixing or of the atomization being necessary. The ideal use of the individual components allows a cost-effective and economic manufacture of the spray mixers which can moreover be carried out in an—at least largely—automated manner. The static spray mixer in accordance with the invention generally requires only three components, namely the one-piece mixer housing, the atomizer sleeve and the mixing element, which can likewise be designed in one piece. A considerable reduction in the complexity results from this in comparison with known apparatus and a substantially simpler manufacture or installation.

In particular to simplify the manufacture even further, it is advantageous if the atomization sleeve is connected in a thread-free manner to the mixer housing.

In a preferred embodiment, the mixer housing has a distal end region which tapers toward the distal end and wherein the inner surface of the atomization sleeve is designed for cooperation with the distal end region. The atomization effect is improved by this tapering.

The outer surface of the mixer housing in the distal end region is preferably designed at least partly as a frustoconical surface.

It has proved to be advantageous in this respect if the frustoconical surface forms a cone angle with the longitudinal axis which amounts to at least 10° and at most 45°.

To realize a uniform distribution of the atomization medium onto the grooves, a ring space is preferably provided between the outer surface of the mixer housing and the inner surface of the atomization sleeve and is in flow communication with the inlet of the atomization sleeve and with the grooves.

So that the material being discharged from the outlet opening of the mixer housing is atomized as homogenously as possible, it is preferred to distribute the grooves uniformly over the outer surface of the mixer housing.

It has proved to be advantageous with respect to the geometry of the grooves if each groove has a depth in the radial direction which is smaller, in particular at most half as large, as the extent of the respective groove in the direction perpendicular to the longitudinal axis and to the radial direction.

Such embodiments are in particular preferred in which each groove has a depth in the radial direction which increases toward the distal end of the mixer housing.

It is advantageous with respect to a particularly simple manufacture or installation if the atomization sleeve is fastened to the mixer housing by means of a sealing snap-in connection.

In a preferred embodiment, the mixer housing has a substantially rectangular, preferably square, cross-sectional surface perpendicular to the longitudinal axis outside the distal end region. The proven mixers which are available under the brand name Quadro® can thereby be used for the static spray mixer.

It is therefore also preferred that the mixing element is designed as rectangular, preferably square, perpendicular to the longitudinal direction, as is the case with the Quadro® mixers.

To ensure a reliable supply of the atomization medium, the inlet of the atomization sleeve preferably has fixing means for a supply for the atomization means.

It is advantageous with respect to a particularly simple and cost-effective manufacture if the mixer housing and/or the atomization sleeve are injected molded, preferably from a thermoplastic.

For the same reason, it is advantageous if the mixing element is designed in one piece and is injection molded, preferably from a thermoplastic.

Further advantageous measures and embodiments of the invention result from the dependent claims.

The invention will be explained in more detail in the following with reference to an embodiment and to the drawing. There are shown in the schematic drawing, partly in section:

DETAILED DESCRIPTION OF THE INVENTION

Figure 1:
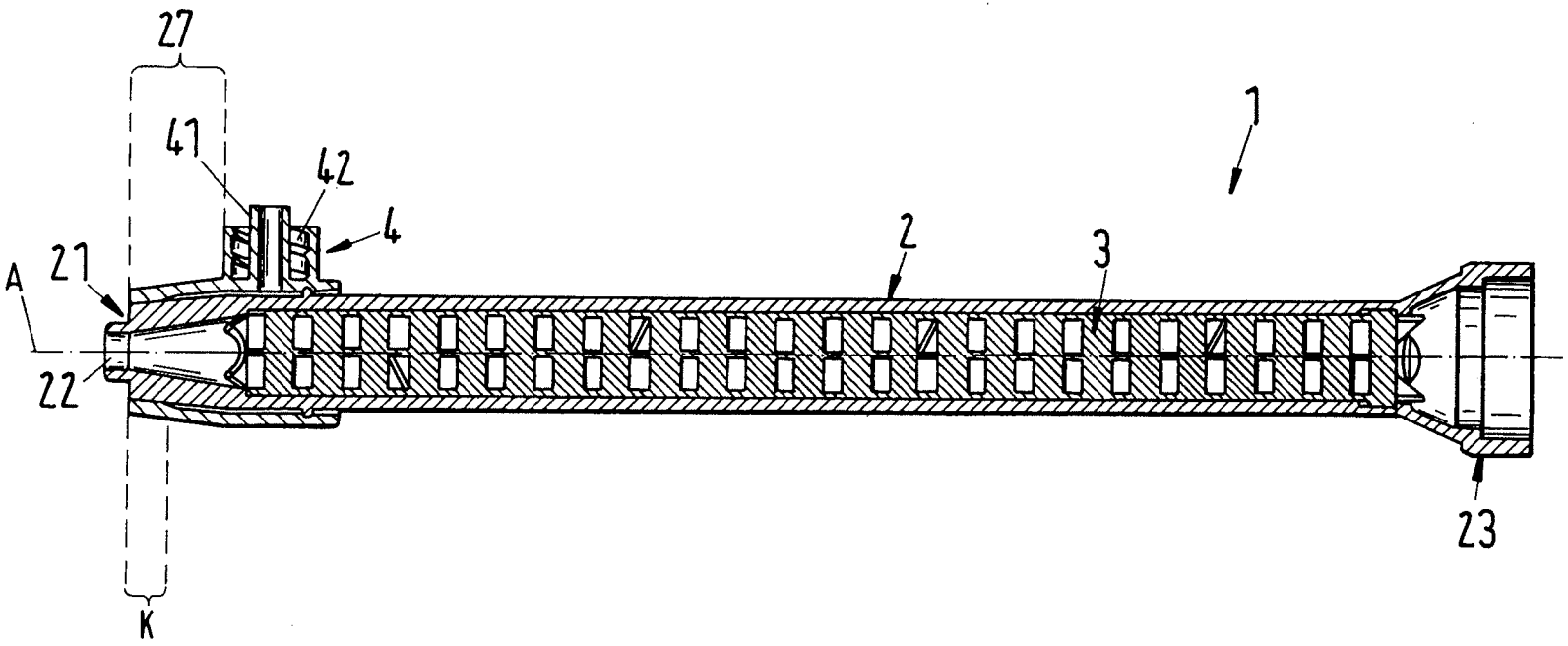
FIG. 1 is a longitudinal section of an embodiment of a static spray mixer in accordance with the invention.
Figure 2:
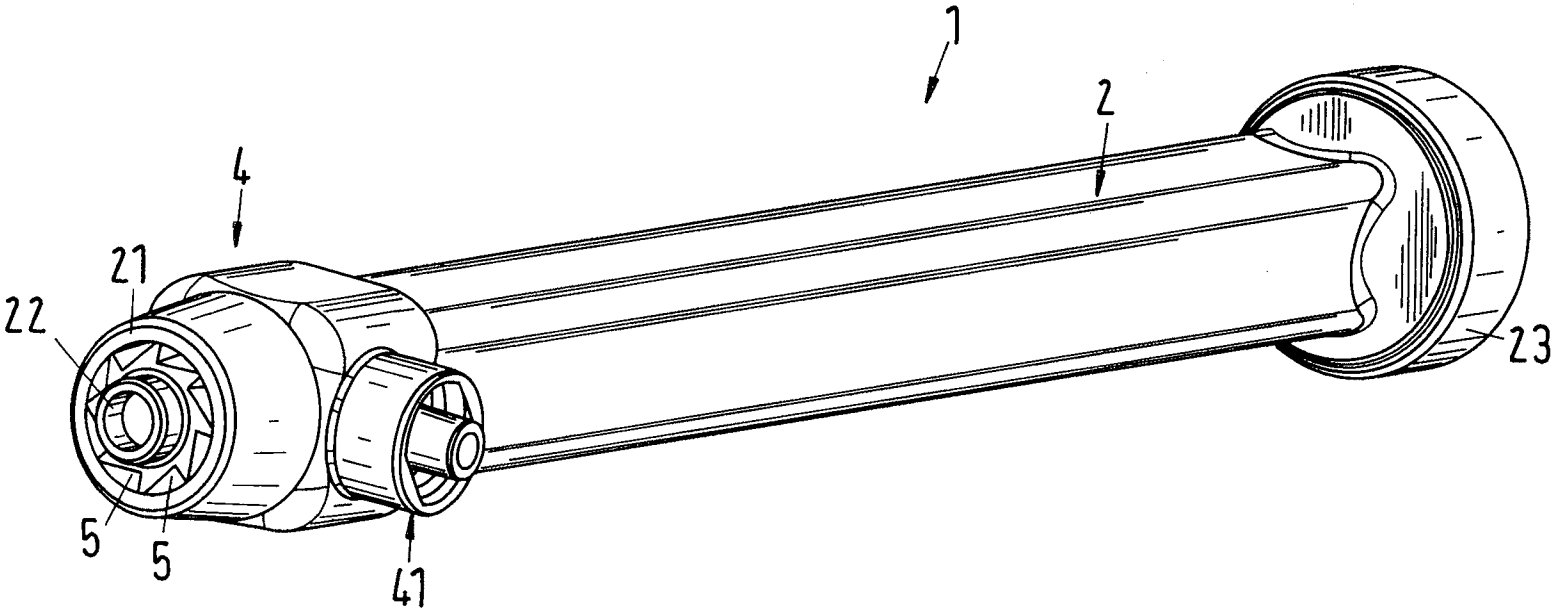
FIG. 2 is a perspective representation of the embodiment of FIG. 1.

FIG. 1 shows a longitudinal section of an embodiment of a static spray mixer in accordance with the invention which is designated as a whole by the reference numeral 1. For better understanding, FIG. 2 shows a perspective representation of this embodiment. The spray mixer serves for the mixing and spraying of at least two flowable components.

Reference is made in the following to the case particularly relevant to practice that precisely two components are mixed and sprayed. It is, however, understood that the invention can also be used for the mixing and spraying of more than two components.

The spray mixer 1 includes a tubular, one-piece mixer housing 2 which extends in the direction of a longitudinal axis A up to a distal end 21. In this respect, that end is meant by the distal end 21 at which the mixed components is discharged from the mixer housing 2 in the operating state. The distal end 21 is provided with an outlet opening 22 for this purpose. The mixer housing 2 has a connection piece 23 at the proximal end, which means that end at which the components to be mixed are introduced into the mixer housing 2, and the mixer housing 2 can be connected to a storage container for the components by means of said connection piece. This storage container can, for example, be a two-component cartridge known per se, can be designed as a coaxial cartridge or as a side-by-side cartridge or can be two tanks in which the two components are stored separately from one another. The connection piece is designed, depending on the design of the storage container or of its outlet, e.g. as a snap-in connection, as a bayonet connection, as a threaded connection or combinations thereof.

At least one static mixing element 3 is arranged in a manner known per se in the mixer housing 2 and contacts the inner wall of the mixer housing 2 so that the two components can only move from the proximal end to the outlet opening 22 through the mixing element 3. Either a plurality of mixing elements 3 arranged behind one another can be provided or, as in the present embodiment, a one-piece mixing element which is preferably injection molded and is made of a thermoplastic. Such static mixers or mixing elements 3 are sufficiently known per se to the skilled person and do not therefore require any further explanation.

Such mixers or mixing elements 3 are in particular suited such as are sold under the brand name QUADRO® by the company Sulzer Chemtech AG (Switzerland). Such mixing elements are described, for example, in the already cited documents EP-A-0 749 776 and EP-A-0 815 929. Such a mixing element 3 of the Quadro® type has a rectangular cross-section, in particular a square cross-section, perpendicular to the longitudinal direction A. Accordingly, the one-piece mixer housing 2 also has a substantially rectangular, in particular square, cross-sectional surface perpendicular to the longitudinal axis A, at least in the region in which it surrounds the mixing element 3.

Figure 3:
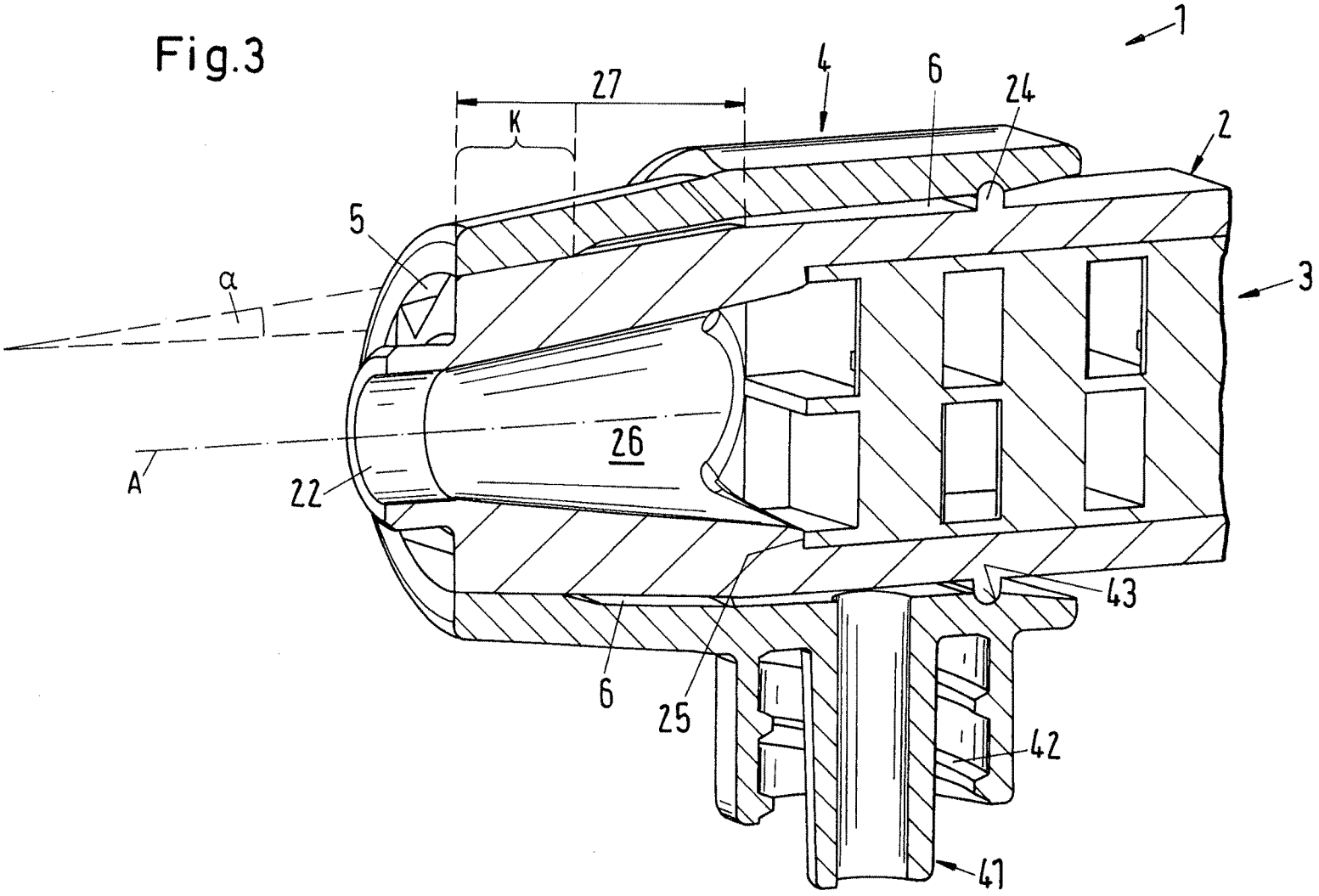
FIG. 3 is a perspective sectional representation of the distal end region.
Figure 4:
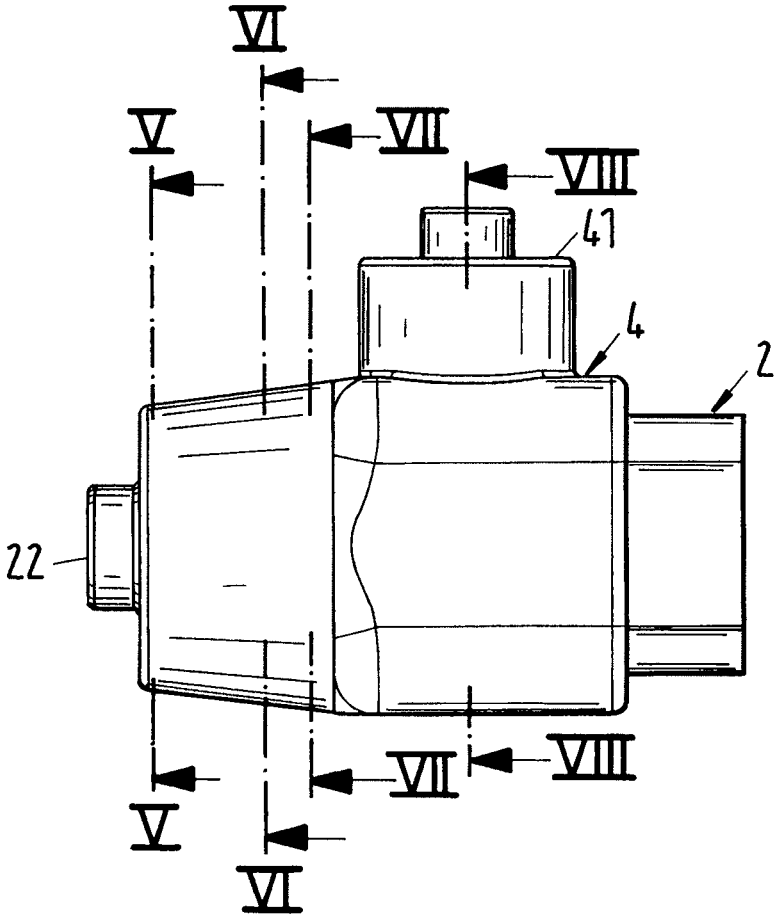
FIG. 4 is a side view of the distal end region.

The mixing element 3 does not extend fully up to the distal end 21 of the mixer housing 2, but rather ends at an abutment 25 (see FIG. 3). Viewed in the flow direction up this abutment 25, the inner space of the mixer housing 2 has a substantially square cross-section to the reception of the mixing element 3. The inner space of the mixer housing 2 merges at this abutment 25 into a circular cone shape, that is has a circular cross-section and forms an outlet region 26 which tapers in the direction of the distal end 21 and opens there into the outlet opening 22.

The static spray mixer 1 furthermore has an atomization sleeve 4 which has an inner surface which surrounds the mixer housing 2 in its end region. The atomization sleeve 4 is designed in one piece and is preferably injection molded, in particular from a thermoplastic. It has an inlet 41 for a pressurized atomization medium which is in particular gaseous. The atomization medium is preferably compressed air. To ensure a secure introduction of the compressed air into the atomization sleeve 4, the inlet 41 has fixing means 42 for the supply of the compressed air, hear a thread, onto which the connection of a compressed air hose can be screwed. Other fixing means 42 are naturally also possible such as a riffling, a clip, a clamping connection or a crimped connection, a bayonet connection or similar. The inlet 42 can be designed for all known connections, in particular also for a Luer lock.

To enable a particularly simple installation or manufacture, the atomization sleeve 4 is preferably connected to the mixer housing in a thread-free manner, in the present embodiment by means of a snap-in connection. For this purpose, a flange-like raised portion 24 is provided at the mixer housing 2 (see FIG. 3) and extends over the total periphery of the mixer housing 2. A peripheral groove 43 is provided at the inner surface of the atomization sleeve 4 and is designed for cooperation with the elevated portion 24. If the atomization sleeve 4 is pushed over the mixer housing 2, the elevated portions 24 snaps into the peripheral groove 43 and provides a stable connection of the atomization sleeve to the mixer housing 2. This snap-in connection is preferably designed in a sealing manner so that the atomization medium, here the compressed air—cannot escape through this connection made up of the peripheral groove 43 and the elevated portion 24.

It is naturally also possible to arrange additional sealants, for example an O ring, between the mixer housing 2 and the atomization sleeve 4.

Alternatively to the embodiment shown, it is also possible to provide a peripheral groove at the mixer housing 2 and to provide an elevated portion which engages into this peripheral groove at the atomization sleeve 4.

Figure 9:
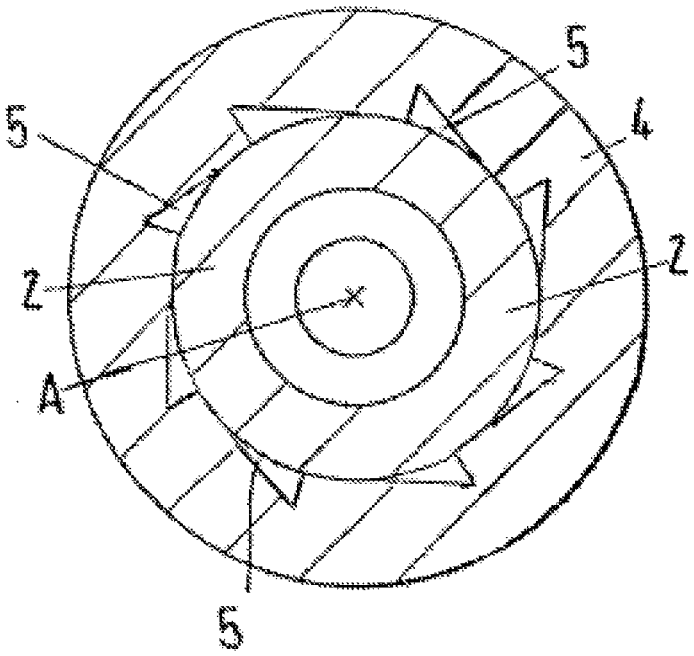
FIG. 9 is a cross-section though an alternative embodiment along the line V-V in FIG. 4.
Figure 10:
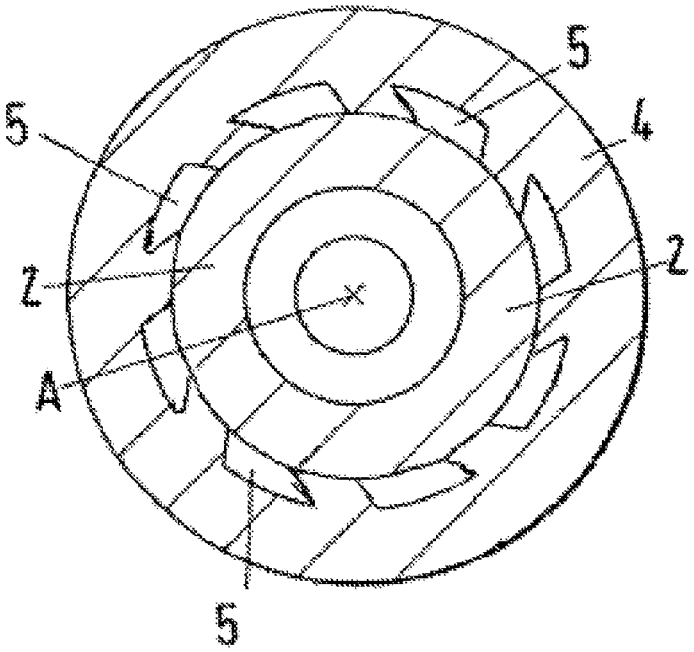
FIG. 10 is a cross-section though an alternative embodiment along the line V-V in FIG. 4.

In accordance with the invention, a plurality of grooves 5 are provided in the outer surface of the mixer housing 2 or in the inner surface of the atomization sleeve 4 which respectively extend in the direction of the longitudinal axis A and through which the atomization medium can flow from the inlet 42 of the atomization sleeve 4 to the distal end 21 of the mixer housing 2. FIG. 9 and FIG. 10 each illustrate embodiments where a plurality of grooves 5 are provided in the inner surface of the atomization sleeve 4 which respectively extend in the direction of the longitudinal axis A and through which the atomization medium can flow.

The term "in the direction of the longitudinal axis A" also means that the respective groove 5 can be curved, for example designed in arcuate form. It is therefore not necessarily the case that each of the grooves 5 has to extend in a straight line in the direction of the longitudinal axis A or toward the longitudinal axis A.

Reference is made in the following to the case that the grooves 5 are only provided in the outer surface of the mixer housing 2. It is, however, understood that the grooves 5 can also be provided in analogously the same manner alternatively or additionally in the inner surface of the atomization sleeve 4.

Figure 5:
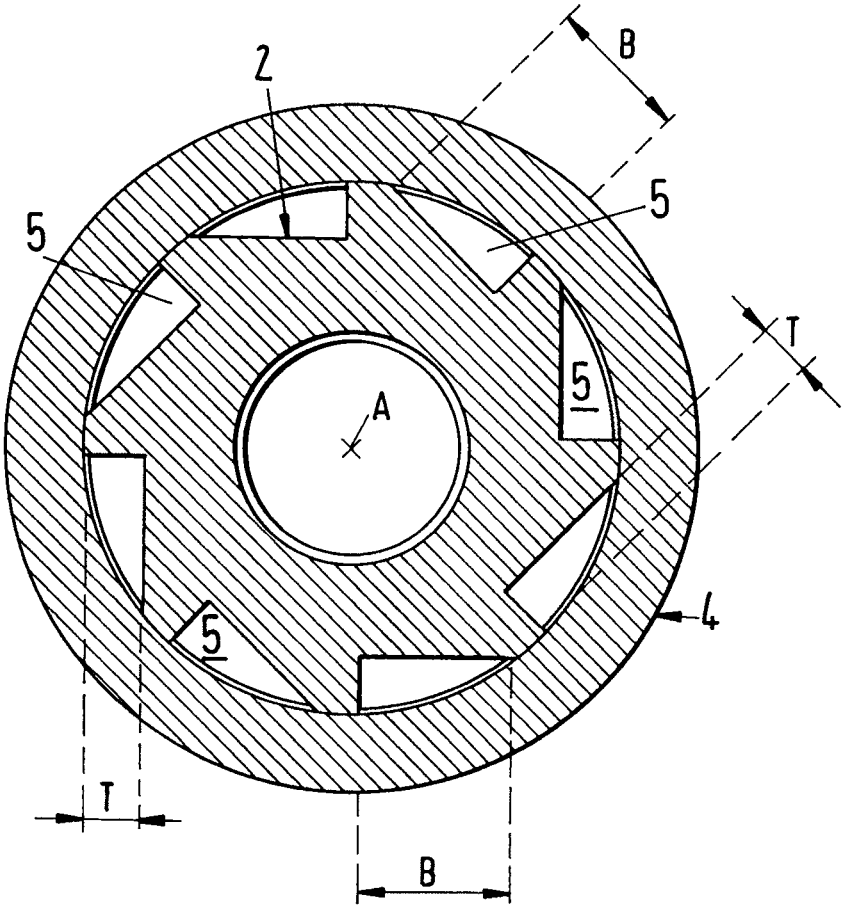
FIG. 5 is a cross-section through the embodiment along the line V-V in FIG. 4.
Figure 6:
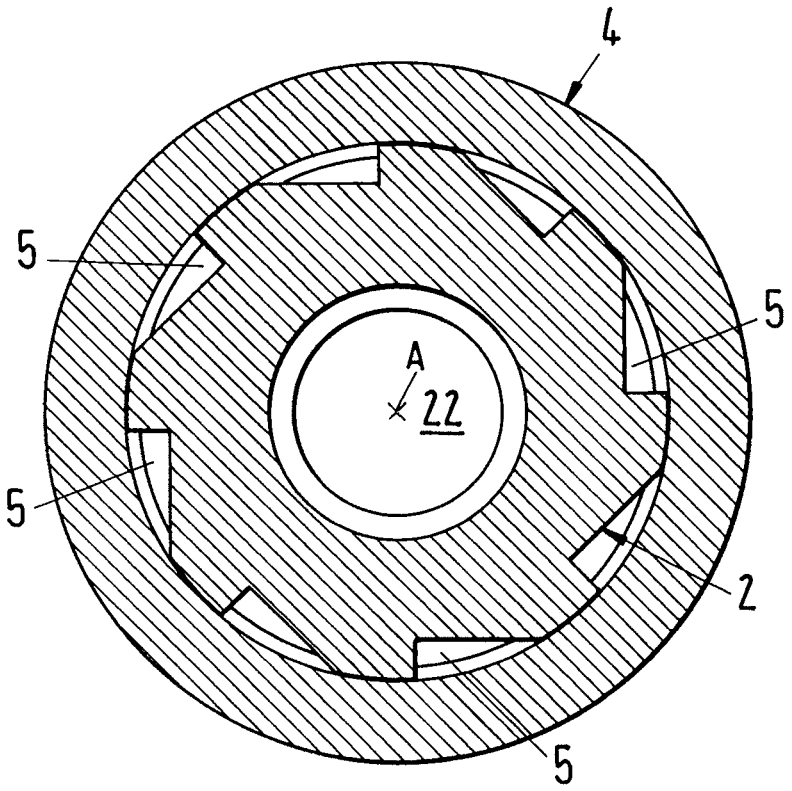
FIG. 6 is a cross-section through the embodiment along the line VI-VI in FIG. 4.
Figure 7:
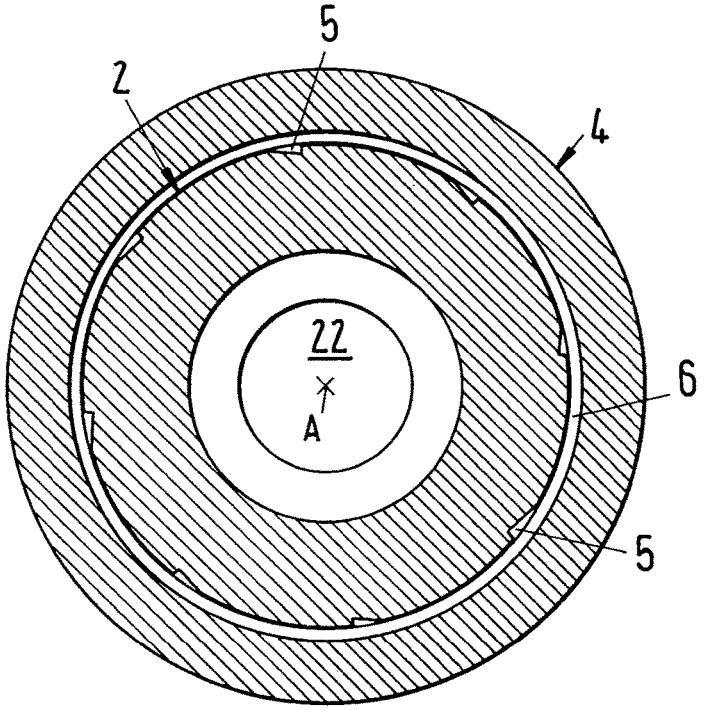
FIG. 7 is a cross-section through the embodiment along the line VII-VII in FIG. 4.
Figure 8:
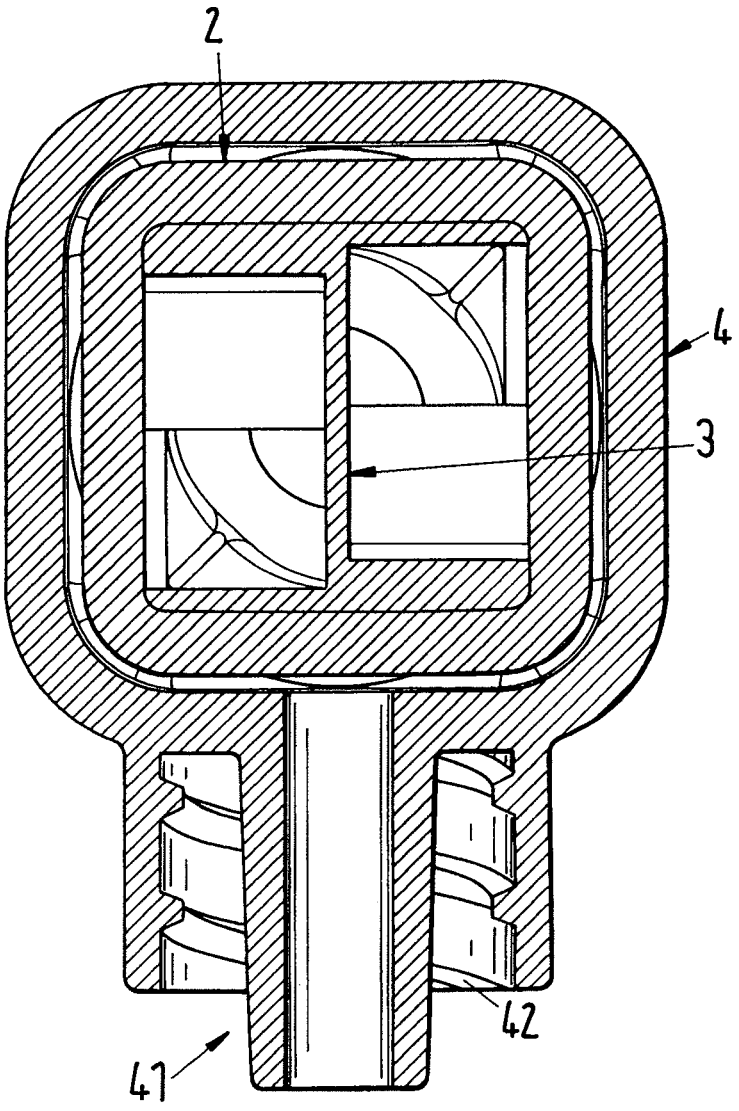
FIG. 8 is a cross-section through the embodiment along the line VIII-VIII in FIG. 4.

Reference is made to FIGS. 3 to 8 for the detailed description of the grooves 5 and of the atomization sleeve 4. FIG. 3 shows a perspective sectional representation of the end region of the static spray mixer, FIG. 4 a side view. FIGS. 5-8 each show a cross-section perpendicular to the longitudinal axis A, and indeed FIG. 5 along the line V-V in FIG. 4: FIG. 6 along the line VI-VI; FIG. 7 along the line VII-VII and FIG. 8 along the line VII-VIII in FIG. 4.

The mixer housing 2 has a distal end region 27 which tapers toward the distal end 21. The outer surface of the mixer housing in the distal end region 27 is in particular designed at least partly as a frustoconical surface. The cone angle $\alpha$ which the outer surface of the mixer housing 2 forms in the distal region 27 with the longitudinal axis A amounts to at least 10° and at most 45°. This cone angle $\alpha$ is generally different from, and specifically smaller than, the cone angle at which the starting region 26 tapers in the inner space of the mixer housing 2.

The inner surface of the atomization sleeve 4 is designed to cooperate with the distal end region 27. In the region at the distal end 21 of the mixer housing 2 designated by K, the inner surface of the atomization sleeve 4 is likewise designed as a frustoconical surface which has the same cone angle $\alpha$ as the outer surface of the mixer housing 2 in this region K. In the region K, the inner surface of the atomization sleeve 4 and the outer surface of the mixer housing 2 contact one another tightly and sealingly so that, in this region K, the grooves 5 in the outer surface of the mixer housing 2 each form a separate flow channel (see FIG. 5).

Upstream of the region K, the inner surface of the atomization sleeve 4 is first still frustoconical, but has a larger cross-section than the outer surface of the mixer housing 2 so that a ring space 6 exists between the outer surface of the mixer housing 2 and the inner surface of the atomizer sleeve 4 (see FIG. 7). The ring space 6 is in flow communication with the inlet 41 of the atomizer sleeve 4. Further upstream, the inner surface of the atomization sleeve 4 merges into a substantially circular cylindrical form, with the ring space 6 also existing here. The ring space 6 is bounded on its side remote from the distal end 21 by the elevated portion 24 which sealingly engages into the peripheral groove 43.

The grooves, there are eight grooves 5 in this embodiment, are distributed uniformly over the outer surface of the mixer housing 2. It has proved to be advantageous with respect to an atomization of the mixed components being discharged from the outlet opening which is as complete and as homogeneous as possible if the compressed air flows generated by the grooves 5 are shallow with respect to the radial direction, that is do not have any extent which is too big in the direction perpendicular to the longitudinal axis A.

A geometry of the grooves 5 suitable for this can easily be recognized in FIGS. 5 to 7. The grooves 5 in the outer surface of the mixer housing 2 are characterized by two dimensions, namely their extent in the radial direction designated as the depth T, with a direction standing perpendicular on the longitudinal axis A being meant by the radial direction which faces outwardly radially from the longitudinal axis A, and its extent B in the direction perpendicular to the longitudinal axis A and to the radial direction. The depth T of each groove 5 is preferably smaller than, in particular at most half as large as, the extent B in the direction at the same point perpendicular to the longitudinal axis A and to the radial direction. The depth T is specifically preferably respectively approximately a third of the extent B.

A further advantageous measure is the fact that, if the grooves 5 are each designed so that their depth T increases, viewed in the flow of direction, that is toward the distal end 21. This feature can be recognized by a comparison of FIGS. 5-7.

Many other embodiments are naturally possible with respect to the geometry and to the extent of the grooves 5. The grooves 5 can also be optimized with regard to the special application case with respect to their number, their extent and their dimensions.

A further variant is the fact that the flange-like elevated portion 24, which can best be recognized in FIG. 3, does not extend in a throughgoing manner over the total periphery of the mixer housing 2, but rather two pairs of flange-like elevated portions exist which are offset to one another with respect to the direction fixed by the longitudinal axis A. An elevated portion provided at the upper side and an elevated portion provided at the lower side of the mixer housing 2 in accordance with the illustration of FIG. 3 then form a pair of the elevated portions; the other pair is formed by an elevated portion provided at the front side and an elevated portion provided at the rear side. Each of the individual elevated portions extends in each case at most over one side of the periphery or, with a circular embodiment, over at most 90° (a quarter) of the periphery. The pair on the upper side and the lower side is in this respect offset to the pair on the front side and rear side with respect to the direction defined by the longitudinal axis A, that is the first named pair is located, for example, closer to the distal end 21 of the mixer housing 2 than the last named pair, with the elevated portions belonging to the same pair each being provided at the same distance from the distal end 21. Accordingly, the peripheral groove 43 does not extend over the total inner periphery of the atomization sleeve 4, but rather two part grooves are provided which are offset by 180° to one another and whose length in the peripheral direction is in each case at most as large as the length of an individual elevated portion. In this embodiment, the atomization sleeve can be pushed onto the mixer housing in two different orientations rotated by 90° with respect to one another. In the one orientation, the part grooves snap into the first pair of elevated portions; in the other orientation, they snap into the second or other pair of elevated portions. The size or the flow cross-section of the ring space 6 or of the grooves 5 can be changed by this measure so that different flows can be set for the atomization medium.

In operation, this embodiment works as follows. The static spray mixer is connected by means of its connection piece 23 to a storage vessel which contains the two components separate from one another, for example with a two-component cartridge. The inlet 41 of the atomization sleeve 4 is connected to a source for the atomization medium, for example to a compressed air source. The two components are now dispensed, move into the static spray mixer 1 and are there intimately mixed by means of the mixing element 3. After flowing through the mixing element 3, the two components move as a homogeneously mixed material through the outlet region 26 of the mixer housing 2 to the discharge opening 22. The compressed air flows through the inlet 41 of the atomization sleeve 4 into the ring space 6 between the inner surface of the atomization sleeve 4 and the outer surface of the mixer housing 2 and from there through the grooves 5 which form flow channels to the distal end 21 and thus to the outlet opening 22 of the mixer housing 3. They here impact onto the mixed material being discharged through the outlet opening 22, atomize it uniformly and transport it as a spray jet to the substrate to be treated or to be coated. Since the dispensing of the components from the storage vessel takes place with compressed air or supported by compressed air in some applications, the compressed air can also be used for the atomization.

A particular advantage of the static spray mixer 1 in accordance with the invention is to be seen in its particularly simple construction and manufacture. In principle, only three parts are required in the embodiment described here, namely a one-piece mixer housing 2, a one-piece mixing element 3 and a one-piece atomization sleeve 4, with each of these parts being able to be manufactured in a simple and economic manner by means of injection molding. The particularly simple construction also enables an—at least largely—automated assembly of the parts of the static spray mixer 1. In particular no screw connections of these three parts is necessary.

The invention claimed is:

1. A static spray mixer for the mixing and spraying of at least two flowable components, the static spray mixer comprising: a tubular, one-piece mixer housing which extends in the direction of a longitudinal axis (A) up to a distal end which has an outlet opening for the components, having at least one mixer element arranged in the mixer housing for the mixing of the components and the at least one mixer element being completely accommodated in the mixer housing as well as having an atomization sleeve which has an inner surface which surrounds the mixer housing in its end region, wherein the atomization sleeve has an inlet for a pressurized atomization medium, characterized in that a plurality of grooves, defined by a space between the mixer housing and the atomization sleeve, are provided in the inner surface of the atomization sleeve which respectively extend in the direction of the longitudinal axis (A) and through which the atomization medium can flow from the inlet of the atomization sleeve to the distal end of the mixer housing.

2. The static spray mixer in accordance with claim 1, wherein the atomization sleeve is connected with a thread-free connection to the mixer housing.

3. The static spray mixer in accordance with claim 1, wherein the mixer housing has a distal end region which tapers toward the distal end and wherein the inner surface of the atomization sleeve is designed for cooperation with the distal end region.

4. The static spray mixer in accordance with claim 3, wherein the outer surface of the mixer housing in the distal end region is designed at least partly as a frustoconical surface.

5. The static spray mixer in accordance with claim 4, wherein the frustoconical surface forms a cone angle (a) with the longitudinal axis (A) which amounts to at least 10° and at most 45°.

6. The static spray mixer in accordance with claim 1, wherein a ring space is provided between the outer surface of the mixer housing and the inner surface of the atomization sleeve and is in flow communication with the inlet of the atomization sleeve and with the plurality of grooves.

7. The static spray mixer in accordance with claim 1, wherein the plurality of grooves are distributed uniformly over the inner surface of the atomization sleeve.

8. The static spray mixer in accordance with claim 1, wherein each groove has a depth (T) in the radial direction which is at most half as big as the extent (B) of the respective groove in the direction perpendicular to the longitudinal axis (A) and to the radial direction.

9. The static spray mixer in accordance with claim 1, wherein each groove has a depth (T) in the radial direction which increases toward the distal end of the mixer housing.

10. The static spray mixer in accordance with claim 1, wherein the atomization sleeve is fastened to the mixer housing by means of a sealing snap-in connection.

11. The static spray mixer in accordance with claim 1, wherein the mixer housing has a substantially rectangular cross-sectional surface perpendicular to the longitudinal axis (A) outside the distal end region.

12. The static spray mixer in accordance with claim 1, wherein the mixer element is designed rectangular and perpendicular to the longitudinal direction (A).

13. The static spray mixer in accordance with claim 1, wherein the inlet of the atomization sleeve is fixed to a supply for the atomization means.

14. The static spray mixer in accordance with claim 1, wherein the mixer housing and/or the atomization sleeve are injection molded from a thermoplastic.

15. The static spray mixer in accordance with claim 1, wherein the mixer element is designed in one piece and is injection molded from a thermoplastic.

16. The static spray mixer in accordance with claim 1, wherein the atomization sleeve is a one-piece atomization sleeve.

* * * * *